US009057024B2

(12) United States Patent
Hayes

(10) Patent No.: US 9,057,024 B2
(45) Date of Patent: Jun. 16, 2015

(54) LIQUEFACTION AND INTERNAL LOGIC FLOW PROCESSING UNIT AND PRIORITIZED COST EFFECTIVE MACHINE APPARATUS USED FOR THE CREATION OF A LIQUID FUEL MATERIAL MADE FROM THE UNDERWATER ARCHING OF CARBON RODS. APPARATUS EMPHASES ARE PLACED ON COST-EFFECTIVENESS AND ENERGY SAVING LIQUEFACTION PROCESS FOR THE REPLACEMENT OF PETROLEUM GASOLINE

(76) Inventor: Thomas Gary Hayes, Norfolk, NE (US)

( * ) Notice: Subject to any disclaimer, the term of this patent is extended or adjusted under 35 U.S.C. 154(b) by 1419 days.

(21) Appl. No.: 12/313,144

(22) Filed: Nov. 18, 2008

(65) Prior Publication Data

US 2010/0122489 A1 May 20, 2010

(51) Int. Cl.

| | |
|---|---|
| ***C10L 5/00*** | (2006.01) |
| ***H05F 3/00*** | (2006.01) |
| ***B29C 59/10*** | (2006.01) |
| ***C25D 17/00*** | (2006.01) |
| ***F01K 13/00*** | (2006.01) |
| ***B01D 19/00*** | (2006.01) |
| ***B01J 19/08*** | (2006.01) |
| ***C10G 1/00*** | (2006.01) |
| ***C10L 1/00*** | (2006.01) |

(52) U.S. Cl.

CPC .... *C10G 1/00* (2013.01); *C10L 1/00* (2013.01)

(58) Field of Classification Search

CPC ... G01N 33/2817; B01J 19/088; C25D 17/00; Y02E 20/12

USPC ..... 44/639; 204/194, 164, 168; 60/645, 60/657; 422/186.21, 186.26

See application file for complete search history.

(56) References Cited

U.S. PATENT DOCUMENTS

| | | | | |
|---|---|---|---|---|
| 5,792,325 | A * | 8/1998 | Richardson, Jr. | 204/164 |
| 6,299,738 | B1 * | 10/2001 | Richardson, Jr. | 204/164 |
| 6,314,918 | B1 * | 11/2001 | McFarland et al. | 123/3 |
| 6,663,752 | B2 * | 12/2003 | Santilli | 204/164 |
| 7,216,484 | B2 * | 5/2007 | Villalobos | 60/645 |
| 2002/0139044 | A1 * | 10/2002 | Berlin et al. | 44/639 |
| 2003/0051991 | A1 * | 3/2003 | Santilli | 204/164 |
| 2003/0106787 | A1 * | 6/2003 | Santilli | 204/164 |
| 2006/0143978 | A1 * | 7/2006 | Hwang | 44/639 |
| 2007/0294935 | A1 * | 12/2007 | Waldron et al. | 44/301 |
| 2009/0165368 | A1 * | 7/2009 | Liu et al. | 44/451 |
| 2009/0241412 | A1 * | 10/2009 | Cook et al. | 44/361 |

* cited by examiner

*Primary Examiner* — Vishal Vasisth

(74) *Attorney, Agent, or Firm* — Patent Law Offices of Rick Martin, P.C.

(57) ABSTRACT

A machine apparatus used for a creation of a combustionable liquid fuel material known as Commercialized Hybrid Hydrogen (CHH) suitable for replacement of petroleum gasoline. Primary objective and conclusion is: the most cost-effective machine apparatus possible for production of CHH. Graphite electrodes immersed underwater are electronically arched. Resulting after combustion carbon molecule emissions ionize with hydrogen and oxygen molecules from the water at about 5000 degrees Celsius. Post-plasmatic discharge rises is captured, refrigerated and pressurized into CHH. All apparatus power requirements are satisfied by CHH internally with the exception of an initial bootstrap power-up cycle. A machine heat exchange run steam turbine provides a secondary energy provision. An internal computer logic flow processing system detects availability of null-costing solar, wind and steam turbine production of electricity prior to using CHH for apparatus power requirements. A recycling consumable graphite rod component furthers existing cost-effectiveness.

3 Claims, 2 Drawing Sheets

Figura-1

LIQUEFACTION AND INTERNAL LOGIC FLOW PROCESSING UNIT AND PRIORITIZED COST EFFECTIVE MACHINE APPARATUS USED FOR THE CREATION OF A LIQUID FUEL MATERIAL MADE FROM THE UNDERWATER ARCHING OF CARBON RODS. APPARATUS EMPHASES ARE PLACED ON COST-EFFECTIVENESS AND ENERGY SAVING LIQUEFACTION PROCESS FOR THE REPLACEMENT OF PETROLEUM GASOLINE

BACKGROUND OF THE INVENTION

The instant apparatus is an answer to replacing the harmful carbon based fuel emissions that are depleting the atmospheric ozone layer and causing global warming. All fossil fuels such as uranium, coal, oil are the primary means from which mankind has satisfied its energy requirements. In order to render energy development without harmful emissions contemporary technologies such as wind turbines and solar technologies have been employed. The problem with steam turbine energy production is that it is primarily used in conjunction with nuclear power which by-product is harmful to the environment.

Contemporarily such technologies uses alternative energy sources that are able to generate electrical power through magnetism and combustion have also turned to cold fusion but have not been able to conclusively develop the idea or determine its safety to the living creation of our world.

The answer to these problems has been here all through the ages: Hydrogen, Carbon and Oxygen. Although mankind has turned fleetingly to these items they have always over thought the process for energy creation through these molecular structures. The problems are 1) as stated above—harmful to humans and all living creatures, 2) costly to make and use alternatives as the cost of production and application negates the making of truly environmentally safe alternatives in our capitalistically based society.

This apparatus allows for a reverse over thinking of energy production. It creates a liquid fuel material made from the nasty stuff comprised in a carbon based after combustion (such as carbon monoxide) and turns it into a fuel that burns that nasty stuff up during the energy creating combustion process. The apparatus then uses that enveloped fuel to propel itself for fuel creation. To conserving on apparatus created fuel usage during fuel production the heat exchange mostly derived from the liquid fuel material powered generator exhaust pipe provides an apparatus steam turbine with steam which also uses a energy conserving perpetual motion process for electrical power generation.

The instant machine apparatus uses the best of the emission free technologies available such as solar and wind turbine when available. When these technologies are not available the apparatus uses its own creation of liquid fuel material until the heat exchange has derived enough energy to power a steam turbine for apparatus power requirements.

SUMMARY OF THE INVENTION

Whereas the apparatus mentioned in claim (1), the machine mentioned and described herein, will also be known as a "Mini Project CHH Liquefaction Machine" which creates a liquid gas to be used as an economical replacement for petroleum gasoline and for all other possible uses of the liquid now known as "CHH" and owned, claimed and invented by Thomas G. Hayes.

1. From an outside source of water the tank is filled and used to immerse and electrically arc carbon rods thereby creating a post-plasmatic discharge, which is then liquefied by the process herein described into "CHH".

From a one-time only bootstrap electrical outlet a direct exterior current will be accepted by all units using and needing an initial electrical supply such as the arching module, the logic flow processing unit, the vacuum and compression unit the refrigeration unit and all other apparatus power requirements.

An arching mechanism containing electrode graphite rods sitting at a depth sufficient to be submerged within water will initiate electrical arching.

The arching will separate the hydrogen and oxygen at 5000 degrees Celsius and the after emissions of the carbon arching will attach to the hydrogen creating a completely and separate structure comprised of a post-plasma discharge.

2. This post plasma discharge will be captured, refrigerated, pressurized and processed into a liquid fuel material (CHH). The apparatus will then use CHH to self-power the invention with use of an electricity producing CHH fueled generator.

3. The liquid fuel material (CHH) will be refined later for use if desired and decided by the owner/inventor Thomas G. Hayes. This includes all output including after emissions and or by-products of the liquid gas known as CHH.

4. As the water usage tanks are depleted the logic flow processing unit will tell the apparatus to refill the water tanks.

Figure 1:
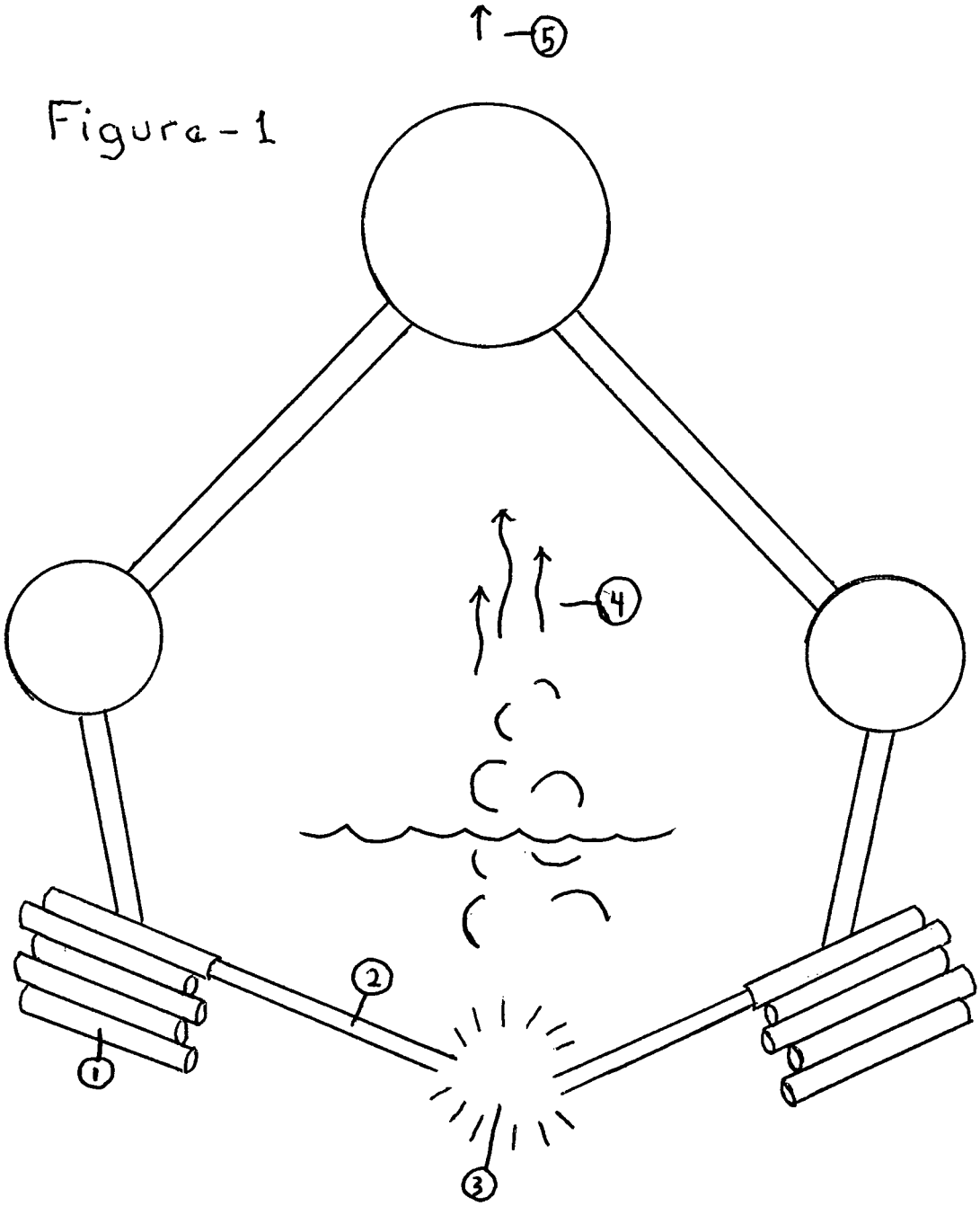
FIG. 1. Is a section of the underwater graphite rod electrode arching mechanism. This section drawing is of the hydraulic arms by which the revolvers and cylinders holding the expendable electrode graphite rods are brought into contact for underwater electric arching (FIG. 1, No. 3). Each arm holds a revolver with a multiple of cylinders (FIG. 1, No. 1). Each cylinder holds a graphite rod electrode, which rotates or spins in opposite directions as the electric arc occurs (FIG. 1, No. 2). A specific spark gap is calibrated between the electrodes by the apparatus logic flow-processing unit to insure continual optimum production of carbon by-product material emissions and heat (FIG. 1, No. 3). As the graphite rod is expended, through the use of mostly, combustion, gravity and processing unit spark gap depth sensors, a continual arc contacting motion is achieved (FIG. 1, No. 3). Raising through the water the post-plasmatic discharge (FIG. 1, No. 4) continues upward to the discharge capturing hood (FIG. 1, No. 5).

The mechanism in FIG. 1 increases productivity of the first stage fuel material process and reduces maintenance time required when a single pair of graphite electrodes are consumed which is beneficial to the cost effectiveness of the overall apparatus performance.

FIG. 1. (FIG. 1, No. 1.) Is one of the two multiple cylinder revolvers at the contacting end of the hydraulic arms within the electric arching chamber component of the apparatus. The purpose of this revolver is: 1) multiple electrodes are configured for electric arc combustion (which supplies the carbon atoms for binding with the hydrogen atoms) at an optimally cost-efficient pace saving maintenance shut down time. 2) Each cylinder is able to individually spin or rotate the contained electrode in opposite directions as it is consumed (FIG. 1, No. 2).

Figure 2:
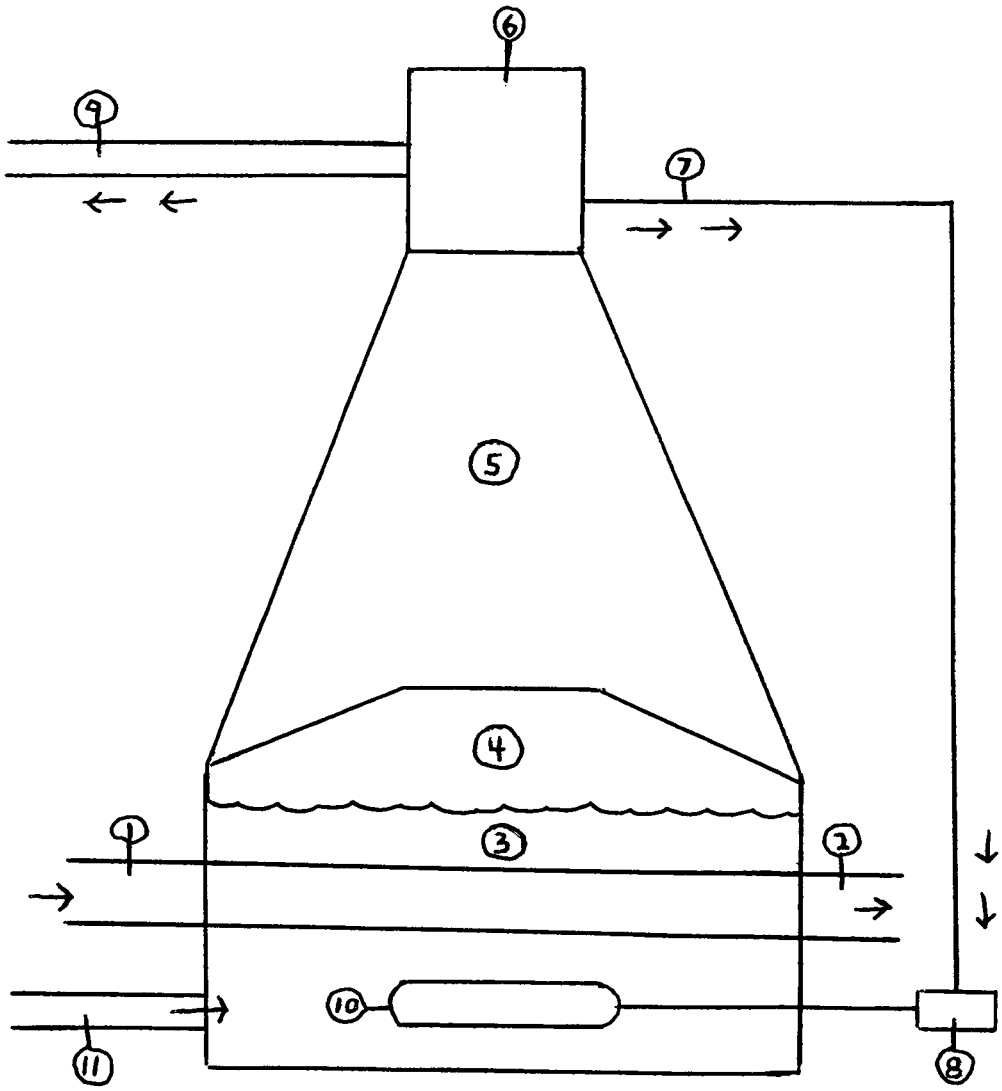

FIG. 2. Is the steam turbine showing the heat-derived form the heated exhaust pipe of the CHH generator through use of the apparatus heat exchange process. As water is heated continually and replaced in the apparatus electrical arching chamber (Shown previously in FIG. 1) it is released to the heat exchange water chamber (FIG. 2, No. 11). Electric energy production is derived from the apparatus heat exchange system and provides an auxiliary power supply for apparatus power requirements (FIG. 2, No. 9). A heated exhaust pipe from the CHH gas generator runs through the heat exchange water chamber (FIG. 2, No. 1). Output exhaust consisting of the CHH generator is disposed of after running through the water chamber (FIG. 2, No. 2). The water in the heat exchange chamber (FIG. 2, No. 3) is heated above the boiling point for steam production (FIG. 2, No. 4). Constant steam pressure tank with thermostat set for 280 to 300 degree (FIG. 2, No. 4) provides energy to run the steam turbine generator (FIG. 2, No. 5). An Internal capacitor and regulator (FIG. 2, No. 6) is included in the turbine and electric power created is sent to both the apparatus (FIG. 2, No. 9) and as a electrical supply to the heating coil (FIG. 2, No. 7). After passing through a battery pack (FIG. 2, No. 8) an alternative heating coil is powered by the turbine generator (FIG. 2, No. 10) which furthers the energy production of the heat exchange in a type of virtual perpetual motion.

DETAILED DESCRIPTION OF THE INVENTION

A machine apparatus used for the creation of a combustionable liquid fuel material suitable for replacement of petroleum gasoline used in automobile engines processed with a cost-effective apparatus which utilizes a prioritizing on-board logic flow processing unit. Machine apparatus creates a liquid fuel material made from the immersed electrical arching of carbon rods and heat separated hydrogen and oxygen formed into an ionized plasma. Initial post-plasmatic material discharge is captured by use of a hood and subsequently vacuumed, pressurized and cooled in the apparatus liquefaction component and stored in first stage storage tanks for subsequent apparatus self-propulsion.

After an initial bootstrap power-up cycle all conventional outside sourced electricity is turned off and the machine then uses its own fuel material whenever null-costing alternative input energy sources are not available for all energy requirements during lifetime usage of the apparatus.

The first stage consists of catching the graphite electrode electric underwater arching after combustion emissions ionized with hydrogen separated from the oxygen at about 5000 degrees Celsius. Resulting plasma is captured and subsequently refrigerated and pressurized. The liquid fuel material output is then placed into an initial storage tank for apparatus use. Liquid fuel material output known as CHH is then used to power on electricity producing generator, which then supplies needed electricity to the arching component.

As the generator exhaust system is heated a heat exchange process is utilized to power steam turbine generators for the creation of electricity needed for the arching component and other apparatus process functions. This saves on the amount of initial liquid fuel material needed for the liquefaction process.

The apparatus involves a logic flow-processing unit to detect when to switch power sources comprising of a combination of the liquid fuel material created (CHH) and the steam turbine electricity generator powered by the apparatus heat exchanger for the most cost effective processing and creation system of any such fuel production.

Outside energy input ports are integrated within the apparatus so that when made available the logic flow-processing unit detects and is able to integrate the use of wind and solar energy creation technology to further the apparatus' cost effectiveness.

The second stage of the liquefaction process initiates when all apparatus power supply is satisfied. This involves continual catching of rising post-plasmatic discharge material produced by the underwater arching component and utilization of a combination of pressure and refrigerating process. The resulting liquid fuel material (CHH) is then made available for subsequent storage as a superior environmentally safe liquid fuel material and cost-effective replacement of petroleum gasoline used in automobiles.

The re-tooling of the automobile industry is not needed for (CHH) automobile engine fuel combustion with the exception of only slight modifications to the automobile gas tank, which can be accomplished as easy as the changing of an exhaust muffler by a muffler shop.

The primary objective and conclusion of the instant apparatus is: 1) To produce the herein mentioned liquid fuel material (CHH); 2) CHH liquid fuel material production in the most cost effective way possible. These primary objectives and conclusions are accomplished by a graphite rod recycling component and through the use of a internalized on-board logic flow processing system that detects the availability and prioritizes the use of solar, wind, and steam turbine production of electricity prior to using the apparatus' own liquid fuel material as a self-powering energy source to the underwater carbon rod arching component and other power requirements of the apparatus.

The invention claimed is:

1. An apparatus for producing liquid fuel, comprising:

a gas generator comprising a pair of hydraulic arms, each hydraulic arm holding a revolver with a plurality of cylinders, each cylinder comprising a graphite rod electrode, each graphite rod electrode immersed in water in an electric arcing chamber, wherein electric arcing between oppositely charged graphite rod electrodes produce a post-plasmatic material discharge;

a steam turbine generator comprising:

a heat exchange water chamber for collecting water discharged by the gas generator, said heat exchange water chamber for producing steam by extracting heat from an exhaust pipe of the gas generator passing through the heat exchange water chamber;

a heating coil immersed in the water inside the heat exchange water chamber for maintaining the water temperature above boiling point; and a steam chamber for collecting the steam produced in the heat exchange water chamber;

said steam turbine for generating electricity using the steam from the steam chamber;

an internal capacitor designed to receive power generated from said steam turbine and transfer power to a battery pack;

the battery pack for storing the electricity produced by the steam turbine, the battery pack powering the heating coil to form an continuous loop of energy production, the steam turbine further providing electricity for self-powering the apparatus; and a hood for collecting the post-plasmatic material discharge and a means for liquefying the post-plasmatic material discharge to produce a liquid fuel.

2. The apparatus according to claim 1, wherein the electric arcing chamber is lined with a disposable and a removable refuse graphite catch bag, and wherein the refuse graphite catch bag is attached to a rim of the electric arcing chamber.

3. The apparatus according to claim 2, further comprising:

electric magnets attached to a plurality of sides of the electric arcing chamber, said electric magnets attracting the graphite chips that are not decomposed, said electric magnets collecting said attracted graphite chips in the refuse graphite catch bag.

* * * * *